US005143684A

United States Patent [19]

Stein et al.

[11] Patent Number: 5,143,684

[45] Date of Patent: Sep. 1, 1992

[54] INSULATED ROLLER ASSEMBLY FOR A ROLLER FURNACE

[75] Inventors: Hermann Stein, Dürkheim; Alwin Vogel, Eisenberg, both of Fed. Rep. of Germany

[73] Assignee: Didier-Werke, Wiesbaden, Fed. Rep. of Germany

[21] Appl. No.: 700,459

[22] Filed: May 15, 1991

[30] Foreign Application Priority Data

Aug. 16, 1990 [DE] Fed. Rep. of Germany ..... 4025935

[51] Int. Cl.[5] ..... C21B 3/00

[52] U.S. Cl. ..... 266/274; 266/287

[58] Field of Search ..... 266/274, 277, 287, 286; 29/130; 432/253, 258, 259, 261

[56] References Cited

U.S. PATENT DOCUMENTS 4,330,912 5/1982 Harris ..... 29/130

FOREIGN PATENT DOCUMENTS 3125440 1/1983 Fed. Rep. of Germany .

3609047 1/1987 Fed. Rep. of Germany .

0145317 7/1985 Japan ..... 266/274

0152615 8/1985 Japan ..... 266/274

*Primary Examiner*—Scott Kastler

*Attorney, Agent, or Firm*—Wenderoth, Lind & Ponack

[57] ABSTRACT

A roller assembly for a roller furnace for heat treating slabs is provided with thermal insulation. A metal roller has carrier rings spaced at intervals thereon for carrying a slab to be treated. A needled first fiber mat surrounds the metal roller between the carrier rings and has a fibrous spraying compound sprayed thereon. A binder in the fibrous spraying compound joins the fiber spraying compound with the first fiber mat. A precompressed second fiber mat is laterally disposed between the carrier rings and the fibrous spraying compound. The result is a thermal insulation arrangement which withstands the dynamic stresses of the roller assembly as well as the chemical stresses due to the presence of a hot slab.

25 Claims, 2 Drawing Sheets

INSULATED ROLLER ASSEMBLY FOR A ROLLER FURNACE

BACKGROUND OF THE INVENTION (1) Field of the Invention

The present invention relates to a roller assembly for a roller furnace for heat treating slabs of steel, etc. The roller assembly has a number of spaced carrier rings for carrying the slabs and thermal insulation between the carrier rings. The slabs are transported through the roller furnace by the roller assemblies on the carrier rings for heat treatment thereof. The hollow cavity of the roller assembly is usually water cooled. The thermal insulation is for protecting the roller assembly from the hot slab, as well as preventing the hot slab from cooling due to the presence of the roller assembly.

(2) State of the Prior Art

DE 32 31 736 C2 discloses a sheathing for insulating a cooled slide, skid or transverse pipe in a furnace. Moldings for the bottom side of the pipe made of a ceramic fiber material and moldings for the upper side of the pipe made of a refractory ceramic are provided for adapting the bottom and upper sides for the different stresses the sides will undergo. This type of an arrangement is unsuitable for a rotating roller assembly. Preformed insulating moldings result in joints in the thermal insulation of the roller assembly. Such joints have a negative impact on the insulating effect of the thermal insulation.

Moldings for insulating pipes are also described in DE 31 25 440 A1 and in DE 36 09 047 A1. The types of moldings described in these disclosures are unsuitable for roller assemblies, since the moldings have very little ability to withstand the dynamic stresses of a rotating roller assembly, and since the joints in the moldings negatively impact on the effect of the thermal insulation.

SUMMARY OF THE INVENTION

Accordingly, the object of the present invention is to provide a roller assembly of the type discussed above having thermal insulation with the ability to withstand the dynamic stresses of the roller assembly in use in a roller furnace, as well as chemical stresses generated by the material being transported by the roller assembly.

According to the present invention, the above object is achieved by the provision of a roller assembly for carrying slabs for heat treatment in a roller furnace, having an elongated roller, a plurality of carrier rings on the elongated roller at spaced intervals for carrying the slabs, and an insulating arrangement on the elongated roller for thermally insulating the elongated roller from the slabs. The insulating arrangement comprises a fiber mat disposed on the periphery of the elongated roller between the carrier rings and a fibrous spraying compound sprayed on the fiber mat, the fibrous spraying compound having a binder therein binding the fibrous spraying compound to the fiber mat.

Preferably, the insulating arrangement further has an expansion joint disposed between the fibrous spraying compound and the carrier rings for expanding in response to shrinkage of the fibrous spraying compound in order to maintain thermal insulation of the elongated roller. This expansion joint comprises a precompressed second fiber mat disposed laterally between the carrier rings and the fibrous spraying compound.

The fibrous spraying compound has good heat insulating properties. Thus a slab transported on the carrier rings of the roller assembly and the roller assembly itself are largely thermally unaffected by each other so that the slab is not cooled by the roller assembly, nor is the roller assembly heated by the slab.

The fibrous spraying compound extends over the entire circumference of the roller assembly, and is in itself jointless. This prevents the scales of the slab or alkali residues of continuous casting powders from being able to damage the roller assembly.

The fibrous spraying compound is securely held on the roller assembly, because the first fiber mat stabilizes the fiber spraying compound, with the binder of the fibrous spraying compound diffusing into the fiber mat. The fibrous spraying compound can then withstand the centrifugal forces generated by rotation of the roller assembly and forces resulting from the acceleration of the roller assembly without breaking or falling off.

The precompressed second fiber mat serves to permanently close the joints resulting between the fibrous spraying compound and the carrier rings. Shrinkage of the fibrous spraying compound will not lead to an open joint between the fibrous spraying compound and the carrier rings, because the second fiber mat is precompressed, and will thus expand to fill the gap with the shrinkage of the fibrous spraying compound.

Preferably, the second fiber mat is precompressed in the direction of elongation of the elongated roller by a factor of 5 with respect to its uncompressed state.

Another preferred feature of the present invention is an arrangement for stabilizing the fibrous spraying compound disposed on the elongated roller. This arrangement includes at least one metal strap disposed about the elongated roller, having brackets extending into the fibrous spraying compound. Each bracket comprises a locking pin attached to the metal strap and a flat shim for attachment to the locking pin. The locking pins extend through the first fiber mat from the metal straps into the fibrous spraying compound. This helps to further stabilize the fibrous spraying compound on the roller assembly.

Preferably, the metal strap is fastened to the elongated roller by a bolt and nut assembly. This is preferred so that welded joints between the elongated roller and the brackets are unnecessary.

The fibrous spraying compound should preferably be made of ceramic fibers. The binder can be a colloidal $SiO_2$ or a hydraulic binder.

The carrier rings can be composed of two spaced ring segments, the spaced ring segments having a non-woven ceramic fabric therebetween, the non-woven ceramic fabric having a latex bond. This further helps to insulate the elongated roller from the hot slabs.

If deemed necessary, a ceramic coating can also be provided on the peripheral surface of the fibrous spraying compound. Also note that the first fiber mat should be a needled fiber mat.

BRIEF DESCRIPTION OF THE DRAWINGS

Further advantages and features of the present invention are discussed below with respect to a preferred embodiment thereof in accompaniment with the attached drawings, in which.

DETAILED DESCRIPTION OF THE PREFERRED EMBODIMENT

Figure 1:
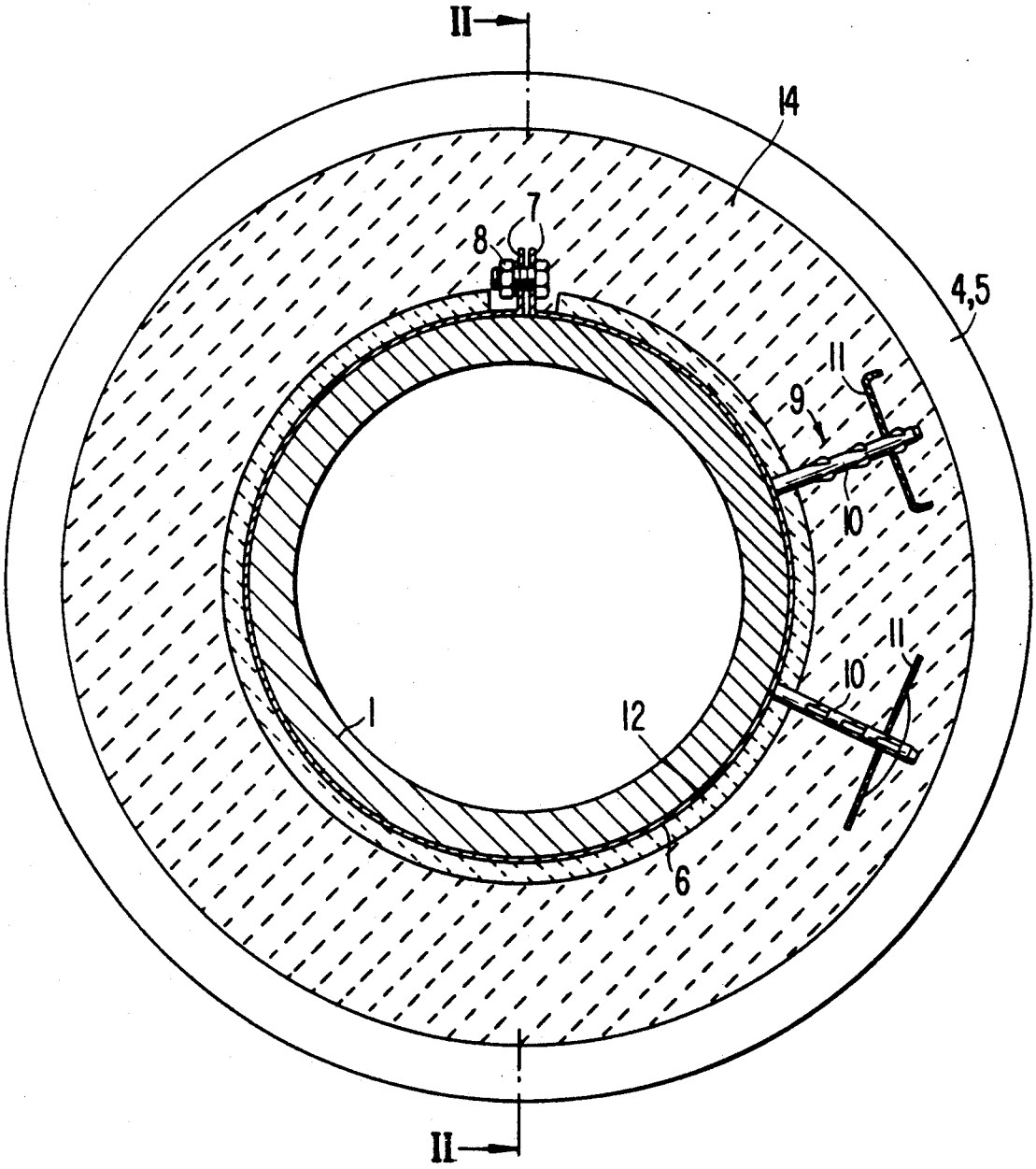
FIG. 1 is a cross-sectional view of a roller assembly according to the present invention, and taken along line I—I of FIG. 2.
Figure 2:
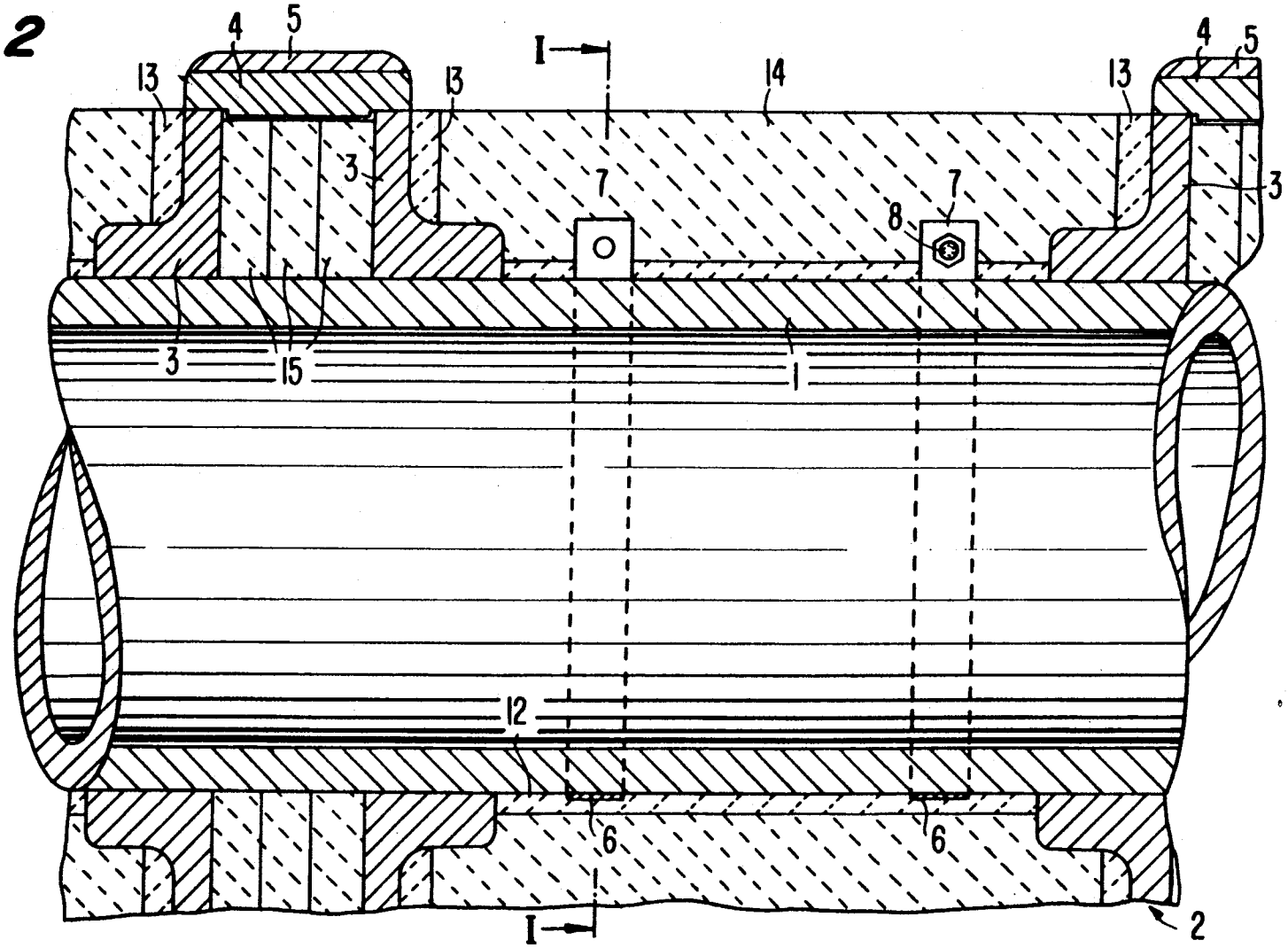
FIG. 2 is a longitudinal sectional view taken along line II—II of FIG. 1.

A roller assembly for carrying hot slabs for heat treatment in a roller furnace has a cylindrical metal roller 1. Distributed over the length of the cylindrical metal roller 1 are several metallic carrier rings 2, as best seen in FIG. 2. Each carrier ring 2 comprises two spaced flange ring segments 3. Between, and on the outer periphery of, the flange ring segments 3 are disposed a supporting ring element 4 and a rolling surface portion 5 attached to the ring element 4. A plurality of metal straps 6 are disposed about the metal roller 1 between the carrier rings 2. Each metal strap 6 has two bent ends 7, as best seen in FIG. 1. The bent ends 7 are connected to each other by a bolt and nut connection 8 so that the metal straps 6 fit snugly on the metal roller 1.

A plurality of brackets 9, for example eight brackets, only two of which are shown in FIG. 1, are welded on the outer peripheral surface of each metal strap 6. Each bracket 9 comprises a locking pin 10 welded to the metal strap 6 and a flat shim 11 locked on the locking pin 10.

After the metal straps 6 have been attached to the metal roller 1, but before the shims 11 have been mounted onto the locking pins 10, a first needled, binder-free fiber mat 12, made of ceramic fibers in blanket form, is disposed about the metal roller 1 between the carrier rings 2. By so placing the first fiber mat 12, the locking pins 10 pierce through the first fiber mat 12.

Noting FIG. 2, precompressed second fiber mats 13 made of ceramic fibers are placed on the sides of the carrier rings 2. The fiber mats 13 are fiber mats which have a low initial density, having a thickness of about 50 mm, but which are compressed from this low initial density by wetting the fiber mat to compress the fiber mat to a thickness of 10 mm. The fiber mats 13 are thus put in place about the carrier rings 2 in their compressed state.

The flat shims 11 are then mounted on the locking pins 10, and a fibrous spraying compound 14 made of ceramic fibers is sprayed between the second fiber mats 13 on the first fiber mat 12 as illustrated in the figures. The fibrous spraying compound has a binder therein. This binder can be a colloidal $SiO_2$ binder, which results in a fibrous compound which has to be dried in order to attain its final strength. The fibrous spraying compound can also be a fiber cement made of ceramic fibers having a hydraulically binding binder. The fiber cement can reach its final strength even at room temperature.

The binder of the sprayed-on fibrous spraying compound 14 partially penetrates the first fiber mat 12 so that the first fiber mat 12 is increased in strength and so that the first fiber mat 12 and the fiber spraying compound are bonded to each other, with the result that the fibrous spraying compound is securely held about the circumference of the metal roller 1. The fibrous spraying compound will thus withstand centrifugal forces generated by rotation of the roller assembly as well as forces resulting from acceleration of the roller assembly. And since the fibrous spraying compound 14 extends over the entire circumference of the metal roller 1, and is in itself jointless, scales from the heat slab carried on the roller assembly, or alkali residue from continuous casting powders, can be prevented from damaging the metal roller 1. The fibrous spraying compound also exhibits good heat insulating properties. Note that the shims 11 serve to further stabilize the fibrous spraying compound 14 about the metal roller 1.

The fibrous spraying compound 14 is sprayed onto the fiber 12 so that the fibrous spraying compound 14 will have a significantly larger thickness than the thickness of the first fiber mat 12, for example by a factor of 7 to 10 times as thick.

After the fibrous spraying compound 14 has been disposed about the first fiber mat 12, the earlier provision of the second fiber mat 13 results in an effective expansion joint being provided at the carrier rings 2 for the protection of the metal roller 1 and the improvement of the overall thermal insulation of the roller assembly. Shrinkage of the fibrous spraying compound 14 in the longitudinal direction of the metal roller 1 will be compensated by the expansion of the precompressed second fiber mats 13. Thus the second fiber mats 13 permanently close the joints between the fibrous spraying compound 14 and the carrier rings 2. The total result is crack and joint free thermal insulation of the metal roller 1. The fibrous spraying compound 14 withstands jolts and vibrations due to the slabs being transported on the carrier rings 2, as well as the centrifugal forces generated thereby.

If necessary, or in an emergency situation, the fibrous spraying compound 14 can have a further ceramic coating provided on its peripheral surface.

A cylindrical space is defined between the flange rings 3 of each carrier ring 2. A plurality of layers of a non-woven ceramic fabric 15 having a latex bond are inserted into the space before assembling the flange ring parts 3 on the metal roller 1. As a result, there is provided additional thermal insulation between the ring element 4 or rolling surface portion 5 and the metal roller 1.

Although the present invention has been described and illustrated with respect to preferred features thereof, it is to be understood that various modifications and changes may be made to the specifically described and illustrated features without departing from the scope of the present invention.

We claim:

1. A roller assembly for supporting slabs in a roller furnace, comprising:

an elongated roller;

a plurality of carrier rings on said elongated roller at spaced intervals;

a first fiber mat disposed on the periphery of said elongated roller between said carrier rings;

a fibrous spraying compound sprayed on said first fiber mat, said fibrous spraying compound having a binder therein binding said fibrous spraying compound to said first fiber mat; and a precompressed second fiber mat disposed laterally between said carrier rings and said fibrous spraying compound.

2. The roller assembly of claim 1, and further comprising a metal strap disposed about said elongated roller, said metal strap having brackets thereon for stabilizing said fibrous spraying compound.

3. The roller of claim 2, wherein said brackets each comprise a locking pin attached to said metal step and a flat shim mountable on said locking pin.

4. The roller of claim 3, wherein said metal strap is fastened to said elongated roller by a bolt and nut connection.

5. The roller of claim 3, wherein aid metal strap is located between said first fiber mat and said elongated roller, said locking pins extending through said first fiber mat.

6. The roller of claim 2, wherein said metal strap is fastened to said elongated roller by a bolt and nut connection.

7. The roller of claim 1, wherein said fibrous spraying compound forms a thicker layer on said elongated roller than said first fiber mat.

8. The roller of claim 1, wherein said second fiber mat is compressed by a factor of five from its uncompressed state.

9. The roller of claim 1, wherein said fibrous spraying compound is made of ceramic fiber and said binder of said fibrous spraying compound is colloidal $SiO_2$.

10. The roller of claim 1, wherein said fibrous spraying compound is made of ceramic fibers and said binder of said fibrous spraying compound is a hydraulic binder.

11. The roller of claim 1, wherein:

each said carrier ring comprises two spaced ring segments; and a non-woven ceramic fabric having a latex bond is disposed between said spaced ring segments.

12. The roller of claim 1, and further comprising a ceramic coating on the surface of said fibrous spraying compound.

13. A roller assembly for carrying slabs for heat treatment in a roller furnace, comprising:

an elongated roller;

a plurality of carrier rings on said elongated roller at spaced intervals for carrying the slabs; and insulating means on said elongated roller for thermally insulating said elongated roller from the slabs, said insulating means comprising:

a fiber mat disposed on the periphery of said elongated roller between said carrier rings, and a fibrous spraying compound sprayed on said fiber mat, said fibrous spraying compound having a binder therein binding said fibrous spraying compound to said fiber mat.

14. The roller assembly of claim 13, wherein said insulating means further comprises:

expansion means disposed between said fibrous spraying compound and said carrier rings for expanding in response to shrinkage of said fibrous spraying compound to maintain thermal insulation of said elongated roller.

15. The roller assembly of claim 14, wherein said expansion means comprises a precompressed second fiber mat disposed laterally between said carrier rings and said fibrous spraying compound.

16. The roller assembly of claim 15, wherein said second fiber mat is precompressed in the direction of elongation of said elongated roller by a factor of five from its uncompressed state.

17. The roller assembly of claim 13, wherein said insulating means further comprises:

stabilizing means disposed on said elongated roller for stabilizing said fibrous spraying compound.

18. The roller assembly of claim 17, wherein said stabilizing means comprises at least one metal strap disposed about said elongated roller having brackets thereon extending into said fibrous spraying compound.

19. The roller assembly of claim 18, wherein each said bracket comprises a locking pin attached to said metal strap and a flat shim on said locking pin.

20. The roller assembly of claim 17, wherein said stabilizing means extends through said fiber mat.

21. The roller assembly of claim 13, wherein said fibrous spraying compound is made of ceramic fiber and said binder of said fibrous spraying compound is colloidal $SiO_2$.

22. The roller assembly of claim 13, wherein said fibrous spraying compound is made of ceramic fiber and said binder of said fibrous spraying compound is a hydraulic binder.

23. The roller assembly of claim 13, wherein:

each said carrier ring comprises two spaced ring segments; and a non-woven ceramic fabric having a latex bond is disposed between said spaced ring segments.

24. The roller assembly of claim 13, wherein said insulating means further comprises a ceramic coating on the surface of said fibrous spraying compound.

25. The roller assembly of claim 13, wherein said fiber mat is needled.

* * * * *